United States Patent [19]

Schwarzenbek

[11] 4,098,678

[45] Jul. 4, 1978

[54] CRACKING CATALYST ACTIVITY MAINTENANCE FOR CATALYTIC CRACKING PROCESS

[76] Inventor: Eugene F. Schwarzenbek, 201 3 Seacrest Dr., Lavallette, N.J. 08735

[21] Appl. No.: 826,378

[22] Filed: Aug. 22, 1977

[51] Int. Cl.[2] ..... C10G 11/04; B01J 8/24; B01J 29/12

[52] U.S. Cl. ..... 208/120; 208/164; 252/415; 252/417; 252/449; 252/455 R

[58] Field of Search ..... 208/120, 164, 108–119; 252/415–418, 449, 455 S

[56] References Cited

U.S. PATENT DOCUMENTS

| | | | |
|---|---|---|---|
| 2,688,401 | 9/1954 | Schmitkons et al. | 209/172 |
| 3,170,865 | 2/1965 | Allen et al. | 208/48 AA |
| 3,498,908 | 3/1970 | Frankovich | 208/112 |

OTHER PUBLICATIONS

W. G. Schlaffer et al., (Shell Dev. Co.) "Aging of Si–Al Cracking Catalyst" J. Phys. Chem. 61, 714–722 (1957).

L. G. Huggett et al., "ICI Symposium on Steam Reforming" (1964).

*Primary Examiner*—Delbert E. Gantz
*Assistant Examiner*—G. E. Schmitkons

[57] ABSTRACT

The activity maintenance of silica containing catalysts used in catalytic cracking operations is improved by the addition to the system of a silica containing compound or mixture which is in a form and in an amount that will readily vaporize in the steam added to or formed in the process. By the method of operation, the refiner is able to realize substantial savings in the amount of catalyst make-up required to maintain a given activity level in the unit.

7 Claims, 2 Drawing Figures

Figure 2:
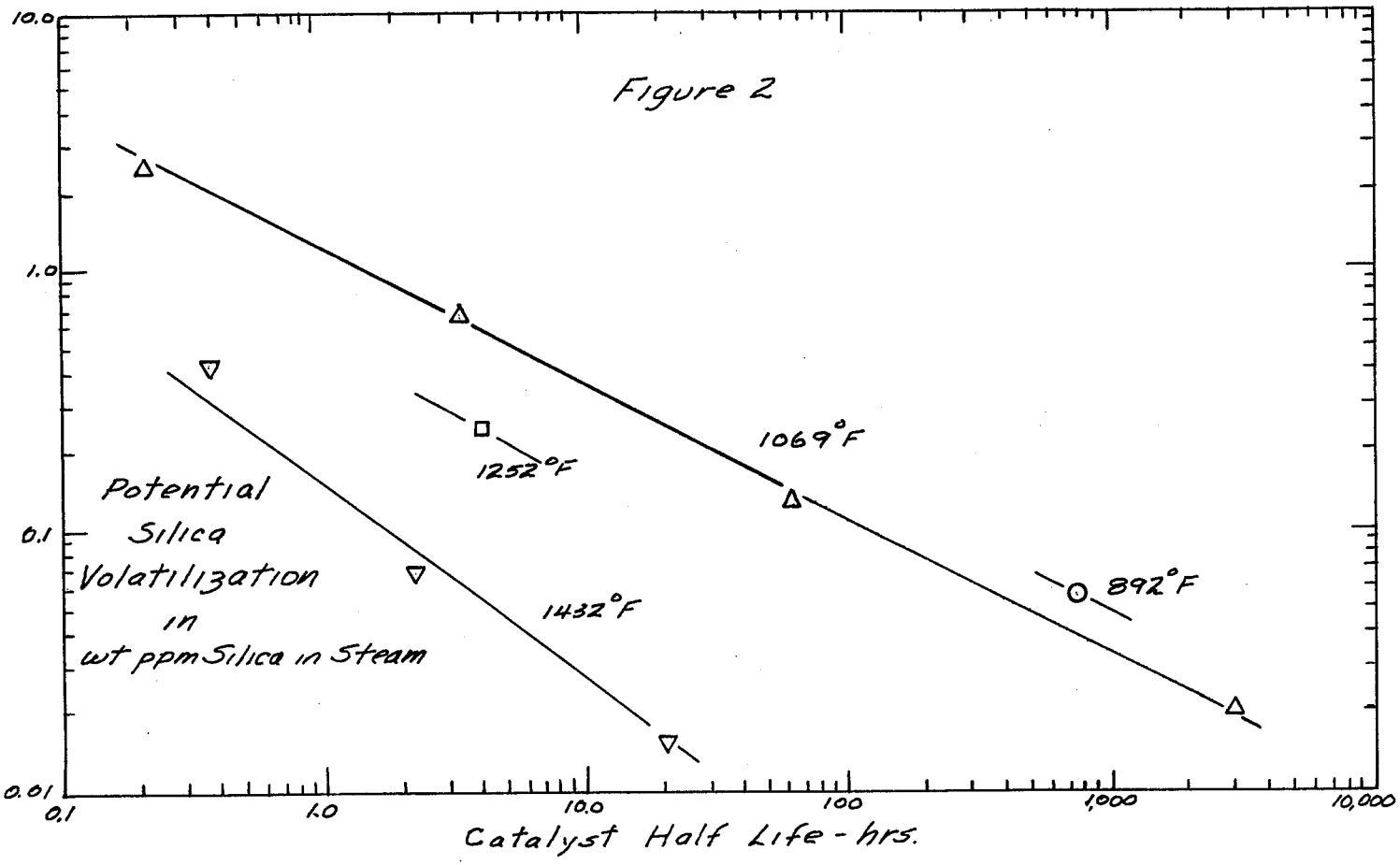

892°F
1069°F
1252°F
1432°F
Potential Silica Volatilization in wt ppm Silica in Steam
Catalyst Half Life - hrs.
10.0
1.0
0.1
0.01
0.1
1.0
10.0
100
1,000
10,000

CRACKING CATALYST ACTIVITY MAINTENANCE FOR CATALYTIC CRACKING PROCESS

BACKGROUND OF THE INVENTION

1. Field of the Invention

The field of art to which the invention pertains is hydrocarbon processing. In particular, this invention pertains to catalytic cracking processes in which the activity maintenance of the catalyst is improved so that a higher activity level or a longer catalyst life can be realized.

2. Description of the Prior Art

In the conversion of crude petroleum oil to usable gasoline product, one of the major processing steps is to catalytically crack the oil boiling in the range of about 400° to 1000° F. The catalyst employed in these cracking processes is usually a silica containing material, most commonly in combination with alumina. The catalyst may be an acid treated silica-alumina clay; an amorphous gel combination of silica-alumina, silica-zirconia, silica-alumina-zirconia, or silica-magnesia; or the silica-alumina zeolites which may be bound in a matrix of clay or amorphous gel material. The catalyst is most commonly used as a powder. In the more common fluid catalytic cracking process, liquid or partially vaporized hydrocarbon feed stock generally contacts hot freshly regenerated catalyst in the lower section of a riser reaction zone. The amount of regenerated catalyst employed is sufficient to supply the heat of vaporization of the oil feed, the endothermic heat of cracking, and the sensible heat required to carry out the cracking reaction at the desired operating temperature. The mixture of oil vapor and catalyst flows up through the high velocity riser, where substantial or all of the desired cracking to the desired lighter products and to coke deposited on the catalyst occurs. The hydrocarbon vapors after separation from the catalyst then flow to a main fractionator where they are separated into such typical fractions as a light gas and gasoline overhead, light cycle oil and heavy cycle oil sidestreams, and a bottom stream which contains fine catalyst which was not collected in the cyclone separator system. The bottom stream is settled to produce a decanted oil fraction and a slurry oil which is returned to either the inlet or outlet of the reaction zone to recover the entrained catalyst fines. The spent catalyst separated from the hydrocarbon vapors in the disengaging zone and cyclone separator system flows to a stripper where the countercurrent flow of stream removes absorbed and interstitial hydrocarbons from the catalyst. The stripped catalyst flows either directly as a dense phase to the regenerator or it may be transported by air to the regenerator. The catalyst in the regenerator is usually maintained as a dense fluid bed, although transport type regeneration or multiple bed type regeneration may be employed. In the regenerator, the catalyst contacts oxygen containing gas which burns the freshly deposited coke from the catalyst.

The amount of air fed to the regenerator is sufficient to burn all the coke deposited in the reaction section and to maintain the residual carbon on the regenerated catalyst at a low level. The freshly regenerated catalyst flows from the regenerator bed through a standpipe and controlled slide valve to the bottom section of the reaction zone where, as previously mentioned, it contacts the feed stock to be cracked.

In these cracking operations, the conditions in the cracking section are usually 900° - 1000° F temperature, 10 - 25 psig pressure and catalyst residence times less than 1 minute. The temperature and pressure in the stripper are similar to the reactor conditions, but the catalyst residence time is 0.5 - 2.0 minutes. In the regenerator the temperature is 1100 - 1400° F, pressure 10 - 50 psig and catalyst residence time 5 - 15 minutes. The total time the catalyst spends in one cycle of cracking, stripping and regeneration is about 10 minutes. Experience has shown that whereas the fresh catalyst may have a surface area of 400 - 600 sq.m./gr., the catalyst inventory has an area of only 50 - 150 sq.m./gr. It is thus apparent that the catalyst being used for the cracking only has 10 - 25% the activity of the freshly prepared catalyst. It is therefore necessary to add a substantial amount of fresh catalyst each day to maintain the activity level of the catalyst in the unit.

The extensive deactivation of the cracking catalyst has been the subject of extensive inventigation. It has been shown that catalyst deactivation can occur from the deposition on the catalyst of such inorganic metals as sodium, which may be present, for example, as a contaminant in the spray water feed; or nickel and vanadium, which may be present as contaminants in the oil feed. However, even when careful control of these contaminants is practiced, severe catalyst deactivation still occurs. It has been concluded that this deactivation of the catalyst is primarily due to the influence of steam. It has been demonstrated that most of the catalysts are thermally stable in the presence of dry air at temperatures as high as 1500° F. However, in the presence of steam at temperatures even as low as 900° F, catalyst deactivation does occur.

The mechanism of the influence of steam on the stability of the cracking catalyst has not been elucidated to date. Catalyst formulation changes have improved the stability characteristics of the catalyst, but extensive deactivation is still experienced in commercial practice. Steps have been taken to minimize the use of steam, but the practice of using large amounts of steam is still being followed. Steam is used with the oil feed to aid in the atomization of the feed and contact with the regenerated catalyst. Steam is used in the stripper to remove absorbed and interstitial hydrocarbons from the spent catalyst before burning with air to remove deposited coke on the catalyst. Steam is also used for aeration in standpipes and for purging in vessels. Attempts have been made to minimize the use of steam, but the alternate processing methods have not been attractive. Also, the complete elimination of steam is not possible, since a significant amount is made in the regenerator as a result of the burning of the hydrogen containing coke from the catalyst.

SUMMARY OF THE INVENTION

The invention claimed can be summarized as a method for minimizing the deactivation of catalyst employed in the cracking of high boiling hydrocarbon oils to valuable gasoline and lower boiling products be feeding to the system a silica containing compound which will readily vaporize in the steam added to or formed in the process.

In a broad embodiment, my invention resides in the addition of a silica containing compound, for example, silicic acid, to the steam employed in the cracking operations for dispersion of the oil, stripping of the spent catalyst, aeration of the standpipe, etc., the amount of silica compound employed being in the order of 0.2 to 20 parts per million of the steam. The silica is added to the steam before the steam contacts the catalyst in the cracking system. The steam is preferably in a superheated form.

In a further embodiment of my invention, silica containing steam is added to the regenerator to minimize catalyst deactivation in this section of the cracking unit.

Figure 1:
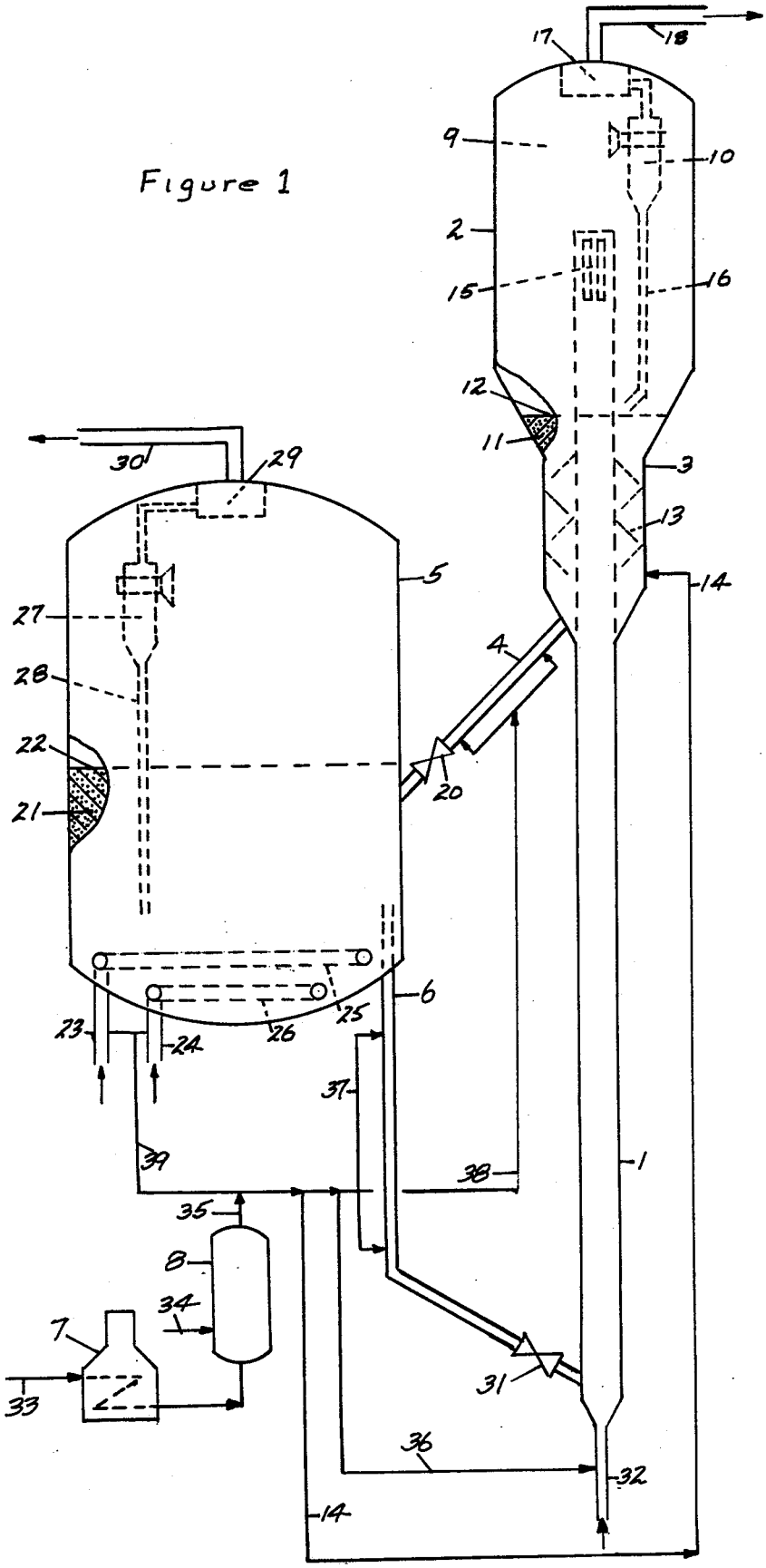

In the drawings attached hereto, FIG. 1 is a detailed description of a typical catalytic cracking operation and shows how my invention may be applied thereto.

FIG. 2 shows how catalyst degradation occurs in the presence of steam.

BRIEF DESCRIPTION OF FIG. 1 OF DRAWINGS

The practice of my invention is illustrated in the attached drawing, FIG. 1, of a modern riser type fluid cracking unit. The essential features of the process of my invention, including a riser reaction zone 1, vessel 2, spent catalyst stripping zone 3, spent catalyst standpipe 4, regenerator 5, freshly regenerated catalyst standpipe 6, steam preheater 7 and silica solubilization vessel 8.

The riser reaction zone 1 is connected to vessel 2, as shown in the drawing. Vessel 2 contains a separator zone 9 in which cyclone separators typical of 10 are located, a bed of catalyst 11 having an interface of 12, and a spent catalyst stripping zone 3 which contains baffles 13 into which flows steam as a stripping medium through feed line 14. The top of riser reaction zone 1 is capped and has exit slots 15 around the periphery of the pipe directing the spent catalyst flow horizontally and then downward to stripping zone 3. The cyclone separators 10 have diplegs 16 which pass catalyst entrained with the effluent vapor from reaction zone 1 and separated from these vapors in the cyclone separator downward toward the stripper catalyst bed. Hydrocarbon vapors and steam pass out of the cyclone separators through a plenum chamber 17 and vapor outlet line 18 to the main fractionator not shown in the drawing.

Spent catalyst standpipe 4 connects vessel 2 and regenerator 5. The conduit contains a slide valve 20 which maintains flow of catalyst from the stripping zone 3 within vessel 2 to regenerator 5.

Regeneration zone 5 contains a fluid bed of catalyst 21 with an interface 22. Air to effect combustion of coke in the bed flows through lines 23 and 24 and is distributed across the cross-sectional area of the bed by distributor pipes or rings 25 and 26. Flue gas flows to cyclone separator 27 which separates entrained catalyst which is returned to the regenerator bed 21 via dipleg 28. The separated flue gas flows through plenum chamber 29 and exits via outlet line 30. The freshly regenerated catalyst flows through the regenerated catalyst standpipe 6 to the base of reaction zone 1. The flow of regenerated catalyst is controlled by slide valve 31 located in regenerated catalyst standpipe 6.

At the bottom of the primary reaction zone 1 is a hydrocarbon feed inlet 32 through which fresh feed enters contacting regenerated catalyst passing through standpipe 6. The feed is vaporized and the resultant vapors carry the regenerated catalyst upward through reaction zone 1. The amount of freshly regenerated catalyst added is controlled by slide valve 31 and the temperature in reaction zone 1, sufficient catalyst being added to vaporize the oil feed and to raise the temperature to the level needed to obtain the extent of conversion and the yield of hydrocarbon products desired.

The catalyst and hydrocarbon mixture exits reaction zone 1 through slots 15 into the separator zone 9 where the bulk of the spent catalyst flows downward to the stripper bed 11 located at the bottom of vessel 2. The remainder of the spent catalyst is entrained with the steam and hydrocarbon vapors and flows to cyclone separator 10 which returns the remainder of the spent catalyst to the stripper bed via dipleg 16. The cyclone separator 10 directs the hydrocarbon vapors out of vessel 2 via plenum chamber 17 and outlet line 18.

Catalyst in dense bed 11 flows downward through stripping zone 3 over baffles 13 and is stripped by a counter-current flow of steam which enters the stripping zone via inlet line 14.

Stripped catalyst leaves vessel 2 through spent catalyst standpipes 4. Slide valve 20 controls catalyst level 12 in vessel 2 and regulates the spent catalyst flow to regenerator 5. Air is fed to regenerator 5 via lines 23 and 24 to burn off the coke deposited in reaction zone 1 to produce freshly regenerated catalyst which flows through standpipe 6 at a rate controlled by slide valve 31 to the bottom section of riser reaction zone 1. Flue gas resulting from the oxidation of coke and catalyst entrained from regenerator bed 21 enters cyclone separator 27. Flue gas from the separator leaves the regeneration zone through plenum chamber 29 and exit line 30, while the separated catalyst is returned to regenerator bed 21 through dipleg 28.

Although single cyclones are shown in vessel 2 and regenerator 5, multiple cyclones in parallel and/or series flow can be used depending on the separation efficiency desired.

The steam employed in the cracking process enters line 33, flows through a superheater furnace 7, and then to vessel 8. A silica containing material is fed through line 34 to vessel 8 where solubilization of silica in steam is effected. The steam saturated with silica exits through line 35 and then flows to various sections of the unit. A portion flows through line 14 as stripping steam to spent catalyst stripping zone 3 where interstitial and absorbed hydrocarbons are removed from the spent catalyst before flowing to regeneration vessel 5. Another portion of the steam flows through line 36 to oil feed line 32 where the steam aids the atomization of the oil as it contacts regenerated catalyst flowing through slide valve 31 to the bottom of reaction zone 1. Steam also flows through line 37 for aeration of the regenerated catalyst standpipe 6 and through line 38 for aeration of the spent catalyst standpipe 4. It may be desirable to add silica saturated steam through line 39 to regenerator 5 to aid in neutralizing the deleterious effect of the steam produced during the burning of the hydrogen containing coke from the catalyst. Steam may be added to other sections of the plant not indicated in the drawing, for example, to the dome sections of the separator vessel 2 and regenerator vessel 5 as purge streams. In all such uses, it is necessary that the steam be solubilized with silica.

BASIS OF THE INVENTION

It is well known in the art that contact of silica-alumina gel or zeolite type catalysts with steam has an adverse effect on the activity of the catalyst. This was illustrated in considerable detail by the work of W. G. Schlaffer, et al., J. Phys. Chem. 61, 714 ((1957). The effect of various aging conditions on the half-life of a silica-alumina gel catalyst is illustrated in Table I.

TABLE I

| t° F | Half-Life of Surface Area Under Various Aging Conditions: Aging Conditions Atm. (Abs.) Steam | $t_{\frac{1}{2}}$ hr. |
|---|---|---|
| 892 | 1 | 740 |
| 1069 | 0.3 | 3000 |
| 1069 | 1 | 60 |
| 1069 | 3 | 3.2 |
| 1069 | 7 | 0.2 |
| 1252 | 1 | 4 |
| 1432 | 0.11 | 21 |
| 1432 | 0.3 | 2.3 |
| 1432 | 1 | 0.37 |
| 1432 | Dry Air | $10^{11}$ |

Half-life, $t$-½, has been defined as the time necessary to reduce the 608 $m^2/gr$ surface area of the original catalyst to 304 $m^2/gr$. The very marked effect of temperature and steam pressure is illustrated. When exposed to 1 atmosphere of steam, the half-life of the catalyst aged at a temperature of 892° F was 740 hours which decreased to 60 hours at 1069° F, 4 hours at 1252° F and finally to only 0.37 hours at 1432° F. The very significant effect of steam was observed at both 1069° F and 1432° F, where at the higher temperature the half-life of 0.37 hours at 1 atmosphere increased to 21 hours when the steam pressure was only 0.11 atmosphere and to an estimated $10^{11}$ hours, or 100 billion hours, when the treatment was carried out in dry air. The high stability of the catalyst when heated in dry air at high temperatures appeared to be a strong indication that the deactivation of the catalyst in the presence of steam could be attributable to a chemical reaction of the catalyst with steam.

In Schlaffer, et al.'s speculations concerning the aging process, they considered volume, surface, and vapor phase transport processes, and appeared to conclude that the mechanism of the aging was indeed complex. The importance of the volume transport process appeared to increase steadily relative to that of surface migration and vapor phase transport as the temperature of the aging increases. They also concluded that the results observed at the lower temperature could be accounted for by a vapor phase transport process involving the formation of volatile species like $Si(OH)_4$.

The vapor phase transport mechanism as an explanation of cracking catalyst deactivation was given added credence from observations made in the development of the modern 1000 T/D ammonia plants. In these plants natural gas and steam were passed through a primary reformer for partial conversion to oxides of carbon and hydrogen, and then mixed with air and passed to a secondary reformer for complete conversion to produce ultimately after CO shift and $CO_2$ removal a gas with the proper hydrogen and nitrogen content. Nickel containing catalysts were employed in both primary and secondary reformers. The effluent from the secondary reformer is at a high temperature and is passed to a waste heat broiler to recover the sensible heat in the gas. Operating difficulties were experienced with the waste heat boiler in that the rate of steam production deteriorated with time. It was soon determined that the loss in heat transfer efficiency was attributable to a scale, containing predominantly silica deposited on the tubes. A study explaining this transfer and deposition of silica was reported by L. G. Huggett, et al., at the ICI Symposium on Steam Reforming held in 1964 at Billingham, England. Huggett, et al.'s report on their work and the work of others carried out in connection with geological studies and with the deposition of silica on turbine blades in power plants operating at very high pressures shows that silica is soluble in steam, forming a hydrate when it vaporizes. The extent of reaction with steam is dependent on temperature and pressure as follows:

$$\log (SiO_2) = \frac{-2300}{°K} + 1.5 \log P + 0.1$$

where $(SiO_2)$ = wt. parts per million of $SiO_2$ in steam $°K$ = temperature in degrees Kelvin $p$ = steam pressure in lbs. per sq. in. absolute The equation shows a saturation content of about 8 wt. ppm of silica in steam at 75 psig and 1500° F. The actual amount melasured in the process water from the ammonia plant was 3 ppm, indicating the process steam was not fully saturated. Although the solubility of silica in steam was only in the low parts per million range, it was apparent that even this small amount could have very deleterious effects on the operability of the process. The nickel reforming catalyst contained silica, and analyses showed that silica was being stripped from the catalyst. The problem with the waste heat boiler was solved by eliminating silica from the system. This involved the use of silica free catalyst, catalyst support materials, and refractory linings.

In view of the demonstrated deleterious effect of steam on the activity of the silica-alumina cracking catalyst and the stripping of the silica from the nickel steam reforming catalyst, it was postulated that the accelerated deactivation of the cracking catalyst in the presence of steam was due to a reaction of silica and steam. Further credence to this theory is illustrated in FIG. 2 where the half-life of the catalyst as presented in Table I has been related to the potential extent of solubilization of silica in steam as determined by the equilibrium relationship developed by Huggett, et al. An inverse log-log relationship is demonstrated. At a temperature of 1069° F and a steam pressure of 7 atmospheres, under which conditions the potential extent of silica solubilization in steam is 2.4 wt ppm, the half-life of the catalyst is only 0.2 hours. At the same temperature but at a steam pressure of 0.3 atmosphere, where the potential solubilization of silica is only 0.02 ppm, the half-life was increased to 3000 hours. Similar effects are shown at a temperature of 1432° F, through the half-life at the higher temperature is less due to the higher reactivity of the silica.

In view of the above, I have concluded that the deactivation of the silica containing catalysts in the presence of steam is attributable to silica solubilization in steam and have conceived that the deleterious solubilization can in effect be neutralized by saturating the process steam being utilized with silica.

The rate of silica solubilization in steam is dependent on the difference in concentration of silica in the steam at equilibrium and that actually present at any particular time. The relationship may be written as follows in differential form:

$$\frac{d(SiO_2)}{d\theta} = K[(SiO_2)eq - (SiO_2)]$$

On integration, the equation becomes:

$$\ln \frac{(SiO_2)eq - (SiO_2)_i}{(SiO_2)eq - (SiO_2)_o} = K\theta$$

where $\theta$ = reaction time $(SiO_2)$ = concentration in wt. ppm of $SiO_2$ in steam at time $\theta$ $(SiO_2)eg$ = equilibrium concentration in wt. ppm of $SiO_2$ in steam $(SiO_2)_i$ = concentration wt. ppm of $SiO_2$ in inlet steam $(SiO_2)o$ = concentration wt. ppm of $SiO_2$ in outlet steam $K$ = reaction velocity constant—a function of temperature and $SiO_2$ solid reactivity Since the reaction of silica with steam is an equilibrium controlling reaction, it is readily apparent that the rate of reaction can be reduced to zero. The above equation shows that the extent of solubilization of silica in steam is critically dependent on the amount of silica present in the inlet steam. If there is no silica in the inlet steam, the silica can be solubilized up to the equilibrium concentration which is dependent on the temperature and steam partial pressure of the system and can be calculated by Huggett, et al.'s equation given above. On the other hand, if the inlet steam contains sufficient silica to give the equilibrium concentration for the temperature and pressure conditions being employed, the reaction rate becomes zero and there will be no added solubilization of silica in steam. I have concluded that under these conditions, the deactivation of the catalyst will be greatly minimized.

THE PRACTICE OF MY INVENTION

In the practice of my invention, the silica added to the steam may originate from a number of different forms. The silica compounds could be inorganic types such as the acids, silica acid or fluorosilicic acid; halides, such as silicon tetra chloride or silicon tetra fluoride; or silicates, such as aluminum or magnesium silicate. Organic silica compounds could be used, such as ethyl ortho silicate, or the silicanes, such as tetra ethyl silicane. The silicon compound, such as solutions of ethyl ortho silicate or silica acid, may be sprayed into the steam or the steam may be saturated by passing over a bed of solid silica containing material, such as silica gel or aluminum silicate. The important criteria of an acceptable silica compound and operating procedure is that it should be of a type that the silica readily reacts with steam to form a silicon dioxide hydrate that vaporizes and saturates the stream of steam. It is also important that the products of the reaction of the steam with the silicon compounds do not contain a secondary component that is detrimental to the activity and selectivity characteristics of the catalyst.

The required amount of silica to be solubilized in the steam is dependent on the operating conditions under which the steam is being used in the process operation. In catalytic cracking operations, the temperature may vary from 900° to 1400° F and total pressure from 10 to 50 psig. The greatest amount of silica solubilized in the steam is required in these sections of the unit operating at the highest temperature and highest partial pressure of steam. An example of a typical cracking operation is presented in Table II.

TABLE II

| | Silica Requirement | | | |
|---|---|---|---|---|
| | Temp °F | Press. psig | Steam psig | $SiO_2$ required in steam at ppm |
| Riser Reactor | 975 | 15 | 3.0 | 0.01 |
| Stripper | 970 | 17 | 31.7 | 0.27 |

TABLE II-continued

| | Silica Requirement | | | |
|---|---|---|---|---|
| | Temp °F | Press. psig | Steam psig | $SiO_2$ required in steam at ppm |
| Spent Catalyst Standpipe | 970 | 25 | 39.7 | 0.38 |
| Regenerator | 1300 | 18 | 2.8 | 0.03 |
| Regenerated Catalyst Standpipe | 1300 | 22 | 36.7 | 1.16 |
| Steam Feed | 366* | 150 | 164.7 | 0.03 |
| | 566 | 150 | 164.7 | 0.23 |
| | 785 | 150 | 164.7 | 1.19 |
| | 970 | 150 | 164.7 | 45.4 |
| Steam Feed | 281* | 50 | 64.7 | 0.002 |
| | 781 | 50 | 64.7 | 0.28 |
| | 970 | 50 | 64.7 | 0.78 |
| | 1100 | 50 | 64.7 | 1.36 |
| | 1300 | 50 | 64.7 | 2.70 |

*Temperature for saturated steam.

The areas of high steam partial pressure and high required silica content in the steam are the stripper, the spent catalyst standpipe and the regenerated catalyst standpipe. A silica content of at least 1.2 ppm is required, though it is recommended that an amount in excess of this be added to assure that the steam is fully saturated. Steam used in catalytic cracking is usually at 50 or 150 psig in a saturated or slightly superheated form. It is apparent from Table II that the saturated silica content of steam under these conditions is too low to meet the high silica concentrations required under cracking unit conditions. Saturated steam at 150 will solubilize only 0.03 ppm $SiO_2$. Superheating 150 psig steam from 366° to 566° F would be partially beneficial in that the silica content at saturation would increase from 0.03 to 0.23 ppm. For full benefit, however, superheating to at least 785° F is desired to obtain about 1.2 ppm silica solubilized in the steam. If the temperature and steam partial pressure conditions in the cracking unit are higher than indicated in Table II, then higher superheat temperatures would be required. If 50 psig saturated steam was used, only 0.002 ppm silica could be solubilized in the steam. Superheating the steam to 781° F would be partially beneficial, but superheating to 1100° F would be more desirable in that 1.4 ppm silica in steam could be obtained.

Obviously, steam pressure and superheat temperature must be correlated to give the desired amount of silica solubilized in the steam.

I claim as my invention:

1. A method of minimizing the deactivation of silica containing catalysts employed in catalytic cracking operations by feeding to the reactor, stripper and regeneration sections steam saturated with silica.

2. The process of claim 1 further characterized in that the silica is present in a vaporous form in the steam in a concentration between 0.2 and 20 parts per million by weight.

3. A method of minimizing the deactivation of silica containing catalysts employed in catalytic cracking operations by feeding to the reactor, stripper, and regeneration sections steam saturated with silica, the silica used to saturate the steam being derived from the group consisting of the inorganic and organic compounds of silicon.

4. The process of claim 3 further characterized in that the silica used to saturate the steam is derived from silicic acid.

5. The process of claim 3 further characterized in that the silica is in the form of a silicon dioxide hydrate.

6. The process of claim 3 further characterized in that the silica used to saturate the steam is derived from ethyl ortho-silicate.

7. A method of minimizing the deactivation of silica containing catalysts employed in catalytic cracking operations by feeding to the reactor, stripper and regeneration sections steam saturated with silica, in which the steam is sufficiently superheated to contain the desired amount of silica at the existing steam pressure.

* * * * *